US005613434A

United States Patent [19]

Hartmann

[11] Patent Number: 5,613,434

[45] Date of Patent: Mar. 25, 1997

[54] METHOD FOR CONTROLLING OR REGULATING THE PRESSING PRESSURE FOR THE SEPARATION OF SOLIDS AND LIQUIDS

[75] Inventor: Eduard Hartmann, Schneisingen, Switzerland

[73] Assignee: Bucher-Guyer AG Maschinenfabrik, Zurich, Switzerland

[21] Appl. No.: 535,088

[22] PCT Filed: Feb. 15, 1995

[86] PCT No.: PCT/CH95/00033

§ 371 Date: Oct. 18, 1995

§ 102(e) Date: Oct. 18, 1995

[87] PCT Pub. No.: WO95/22453

PCT Pub. Date: Aug. 24, 1995

[30] Foreign Application Priority Data

Feb. 18, 1994 [CH] Switzerland ..... 491/94

[51] Int. Cl.[6] ..... B30B 9/02

[52] U.S. Cl. ..... 100/37; 100/43; 100/50; 100/99; 100/104; 426/231; 426/478; 426/489

[58] Field of Search ..... 100/37, 43, 50, 100/99, 104, 107; 99/486, 495; 426/231, 478, 489

[56] References Cited

U.S. PATENT DOCUMENTS

| | | | |
|---|---|---|---|
| 5,167,832 | 12/1992 | Carlsson et al. | 100/37 |
| 5,207,154 | 5/1993 | Bonnet | 100/37 |
| 5,231,922 | 8/1993 | Hartmann | 100/37 |

FOREIGN PATENT DOCUMENTS

| | | | |
|---|---|---|---|
| 0304444 | 10/1991 | European Pat. Off. . | |
| 0485901 | 5/1992 | European Pat. Off. . | |
| 2253468 | 7/1975 | France | 100/37 |
| 2411699 | 7/1979 | France | 100/43 |
| 2590046 | 5/1987 | France | 100/43 |
| 2597629 | 10/1987 | France | 100/43 |
| 2057300 | 5/1972 | Germany | 100/43 |
| 55-88999 | 7/1980 | Japan | 100/37 |
| 531765 | 11/1976 | U.S.S.R. . | |
| 88/06518 | 9/1988 | WIPO . | |

*Primary Examiner*—Stephen F. Gerrity
*Attorney, Agent, or Firm*—Burns, Doane, Swecker & Mathis, LLP

[57] ABSTRACT

A cyclically operating filter press for squeezing juice from fruit is controlled so that the pressing pressure rises during an early part of a cycle and then, at a time determined in view of actual process variables, the pressure increase is stopped and the pressing pressure remains constant thereafter. The limiting time for the pressure rise is determined with a process.

8 Claims, 9 Drawing Sheets

METHOD FOR CONTROLLING OR REGULATING THE PRESSING PRESSURE FOR THE SEPARATION OF SOLIDS AND LIQUIDS

FIELD OF THE INVENTION

The invention relates to a method for controlling or regulating the pressing pressure for the separation of solids and liquids from the material for pressing by means of a press, which performs at least one pressing cycle during a pressing operation by means of a pressure increase.

DESCRIPTION OF THE PRIOR ART

In presses of this kind, the material for pressing is filled and emptied in the form of individual batches, which are separate from each other. The presses are therefore designated as discontinuous. Currently there are a number of known discontinuous filter presses, which work in batch operation. They are embodied as piston presses, chamber filter presses, tank presses, packing presses, basket presses, etc.; the increase in pressing pressure is carried out via plates, pistons, or diaphragms, with hydraulic, pneumatic, or mechanical pressing means.

Pressing materials that are to be processed in these presses frequently have a widely varied pressability. Furthermore, even successive batches on occasion vary widely in pressability. These circumstances make it very difficult to preset operating parameters for the course over time of the pressure increase on the basis of experiments. EP-B 0 304 444 and EP-A 0 485 901 have also disclosed a plurality of methods which permit an automatic control or regulation of the pressure increase, suited to the material for pressing.

This kind of known method for controlling or regulating the pressing pressure level currently have the following disadvantages:

- Desired value presets are still required, which have to be determined based on empirical values. That is why the above mentioned difficulties cannot be avoided when there are widely varying properties of the material to be pressed.
- A further disadvantage of known, adaptive methods is that the optimization sought is not achieved in practice, and that in comparative tests with methods that use preset empirical parameters, even better results are achieved with methods of this kind.
- Finally, it is not possible to attain both the optimization aims and the economic aims together.

SUMMARY OF THE INVENTION

The object of the invention, therefore, is to disclose a method of the above mentioned kind for controlling or regulating the pressing pressure, which avoids the disadvantages mentioned.

According to the invention, the attainment of this object is achieved by the fact that the discharge of the liquid phase from the press is directly or indirectly measured, and that from the course over time of the discharge behavior of this phase, a time is determined at which the further pressure increase is limited to a constant value for each pressing cycle, this time lies within a time interval which starts at the beginning of the discharge and ends after the ending of a length of time that is equal to twice the time between the start of the discharge and the onset of the maximal average flow capacity of the liquid phase.

Advantageous embodiment forms of the method for determining such a time as well as the use of this method can be inferred from the claims.

BRIEF DESCRIPTION OF THE DRAWINGS

Exemplary embodiments of the invention are explained in the following description and the figures of the drawing.

DESCRIPTION OF PREFERRED EMBODIMENTS

Figure 1:
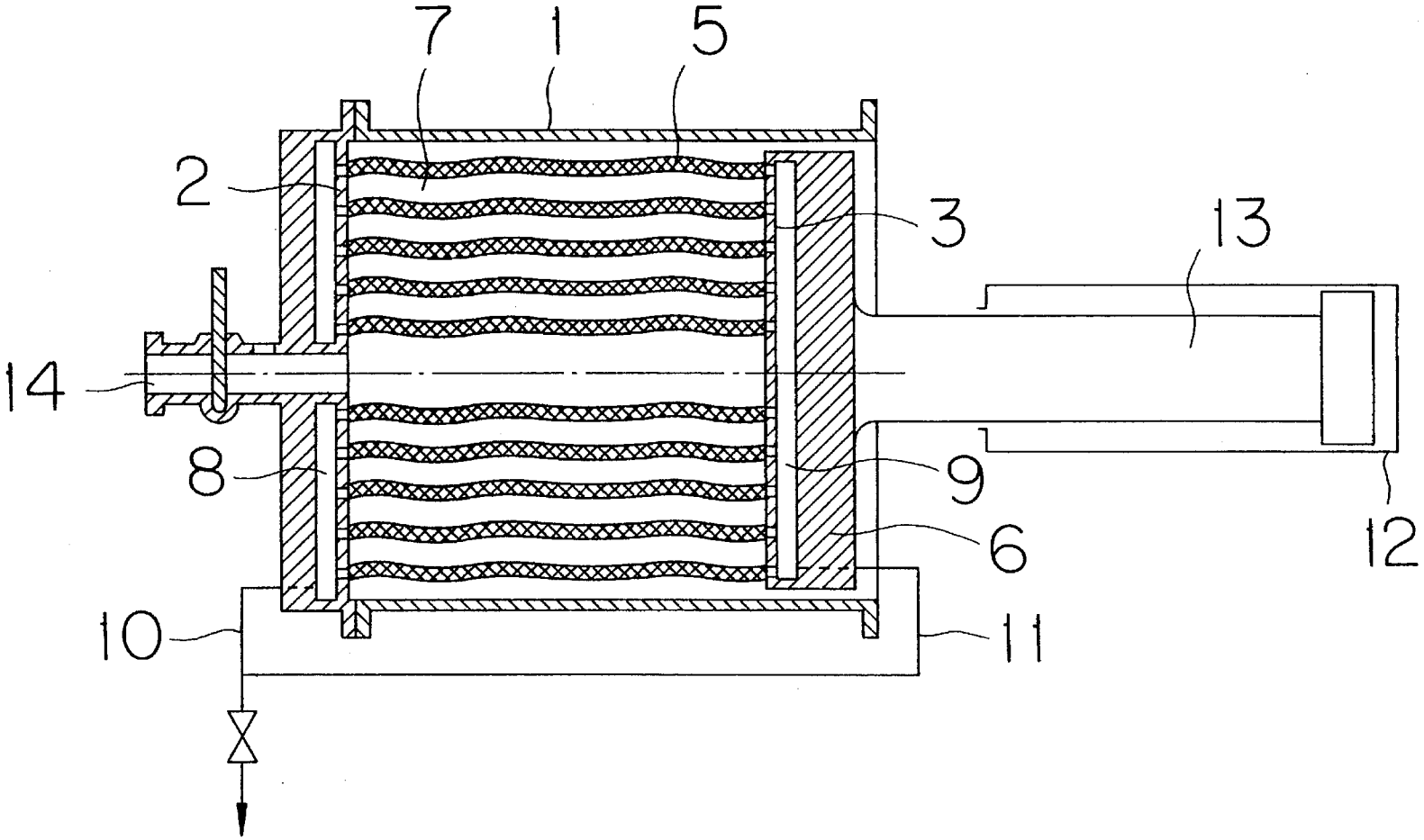
FIG. 1 PRIOR ART
FIG. 1 shows a partial section through a horizontal filter piston press for carrying out the method according to the invention.

FIG. 1 schematically shows a known kind of horizontal filter piston press. It includes a pressing jacket 1, which is detachably connected to a pressure plate 2. The second pressing plate 3, which is fastened to a piston rod 13 via a pressing piston 6, is disposed inside the pressing jacket 1, opposite the pressing plate 2. The piston rod 13 is movably supported in a hydraulic cylinder 12 and executes the pressing operations via the pressing piston 6. The material for pressing 7, or in other words the material to be pressed, or pressing material, is introduced between the pressure plates 2 and 3 via a closable filling opening 14, through which material a number of drainage elements 5 extend.

In the pressing operation, the drainage elements 5 conduct the liquid phase of the pressing material 7 into collecting chambers 8 and 9, which are disposed behind the pressure plates 2 and 3. The material to be pressed can be fruit, and in the liquid phase can consequently be fruit juice. Under the pressing action of the pressing piston 6, the liquid phase comes from the pressing material 7 via the collecting chambers 8, 9, and flows outward into discharge lines 10, 11. The pressing pressure is produced in the hydraulic cylinder 12. There is a force-transmitting connection, not shown, between the front pressure plate 2 together with the pressing jacket 1 on the one hand and the cylinder 12 on the other. After the pressing operation is over, the emptying of the press is carried out by loosening and axially sliding the pressing jacket 1 from the pressure plate 2.

The known course of the method of pressing is normally as follows:

Filling operation:

The pressing jacket 1 is closed with the pressure plate

The pressing piston 6 is retracted,

The pressing material 7 is fed in via the opening 14.

Pressing operation:

The entire pressing unit shown in FIG. 1 is rotated around the middle axis,

The pressing piston 6 is moved forward under pressure,

The juice is separated from the pressing material by pressing,

The pressing pressure is turned off.

Loosening operation:

The pressing piston 6 is retracted by rotating the entire pressing unit shown in FIG. 1; the remaining pressing material is loosened and broken up.

Further pressing operation:

The method steps of pressing and loosening are repeated a plurality of times per batch in the form of pressing cycles, until a desired final and pressed state is achieved.

Emptying operation:

The pressing residues are emptied at the side of the pressure plate 2 by opening the pressing jacket 1 of the pressure plate 2.

Figure 2:
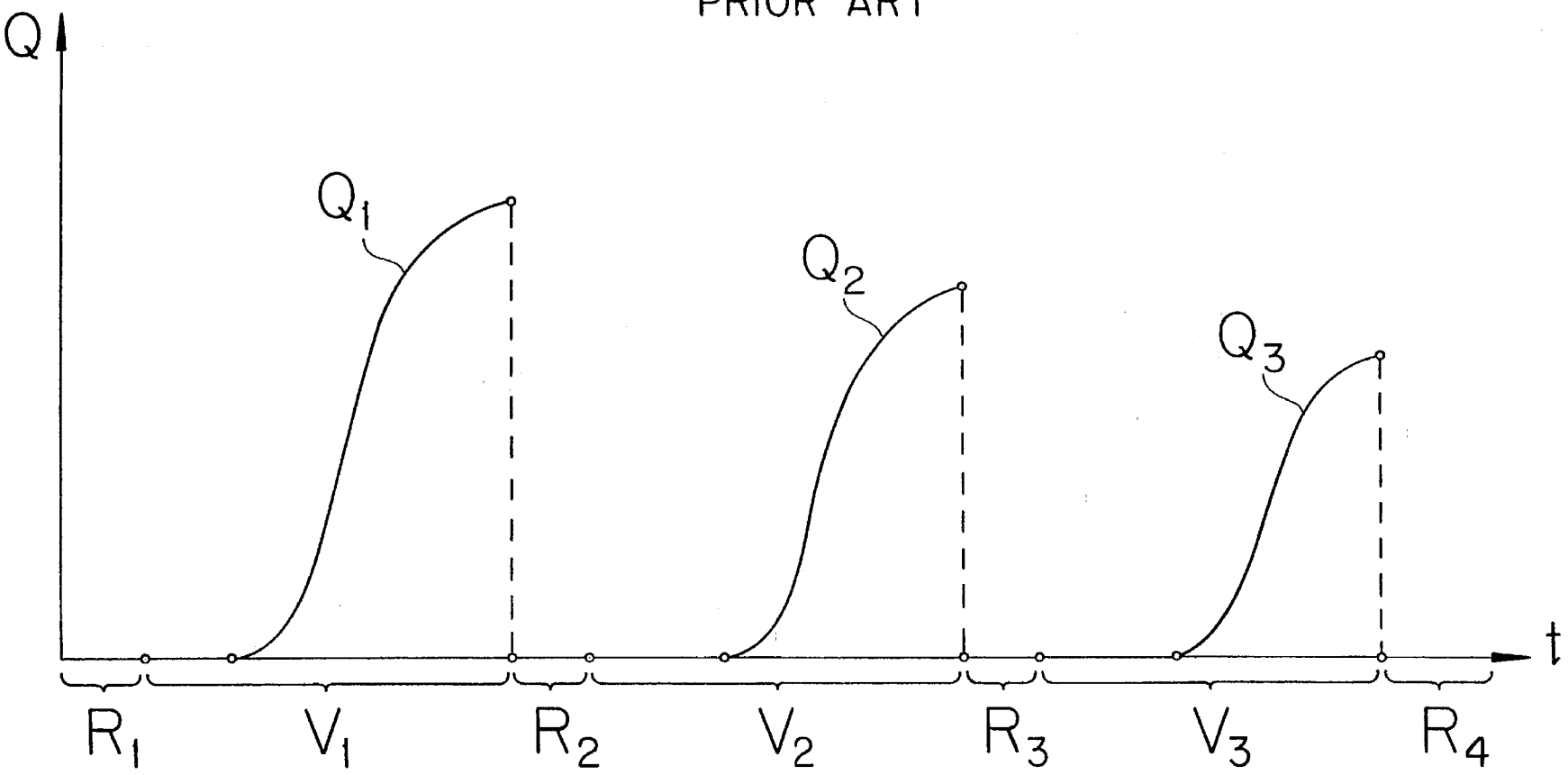
FIG. 2 PRIOR ART
FIG. 2 is a graph showing the course over time of the discharge behavior of the liquid phase of a press according to FIG. 1.

For the described, known course of the method, FIG. 2 shows the course over time of the pressed-out liquid quantities Q1, Q2, and Q3 per stroke of the pressing piston 6 for three successive pressing cycles. Each pressing cycle shown begins after the end of the preceding discharge with the piston backstroke R1–R3 indicated on the time axis t, with breakup and loosening of the pressing material 7, followed by a forward piston movement V1–V3 with the pressing-out operation of the fluid quantities Q1–Q3. For better recognizability, in FIG. 2, in each pressing cycle, the liquid quantity Q1–Q3 begins with the value zero, although these quantities Q1–Q3 have to be added for the entire pressing operation.

Figure 3:
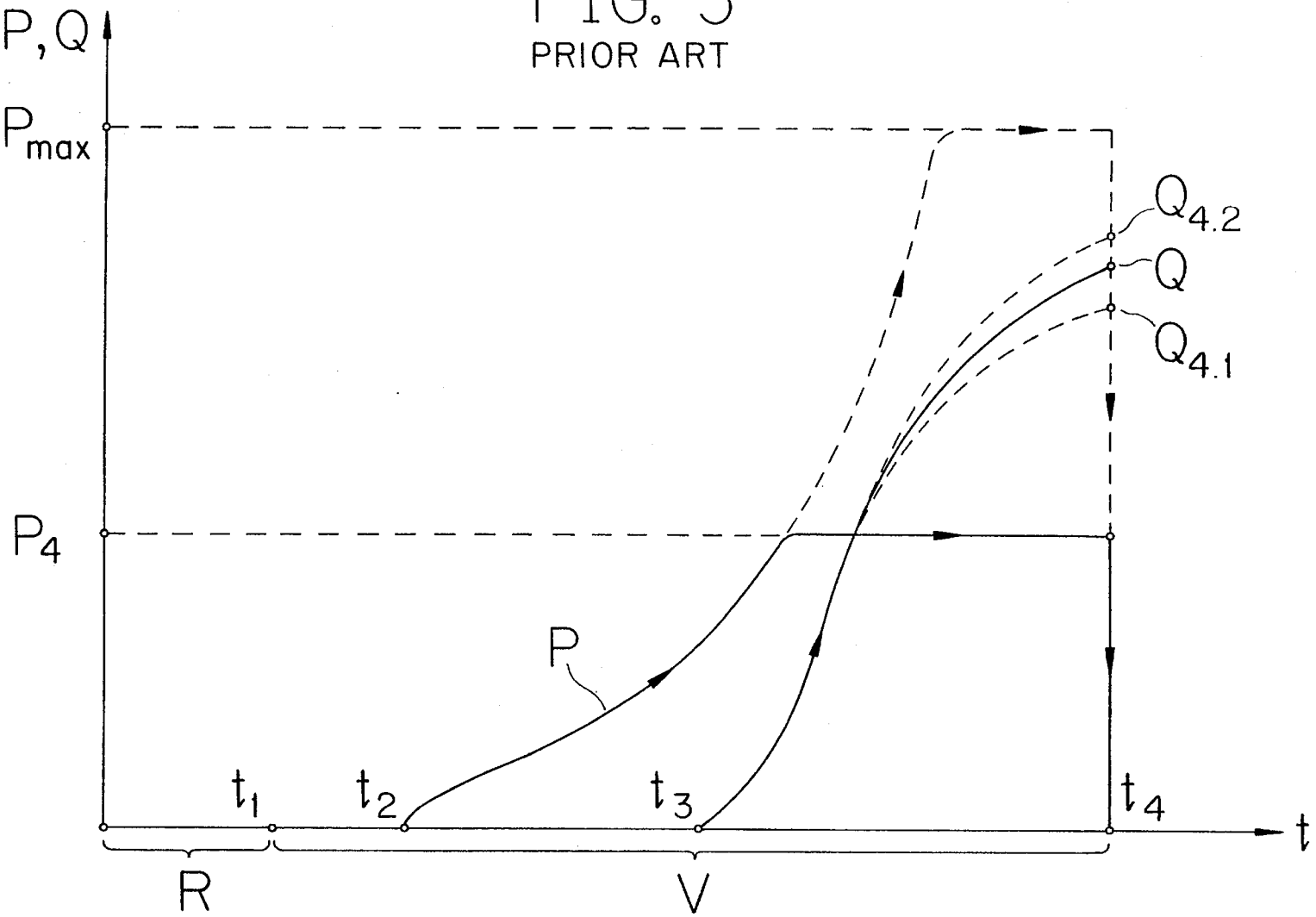
FIG. 3 PRIOR ART
FIG. 3 is a graph showing the course over time of the pressing pressure and of the pressed-out quantity of liquid in an individual piston backstroke and the following piston forward motion of a press according to FIG. 1.

In FIG. 3, not only the pressed-out fluid quantity Q but also the course over time of the pressing pressure P during a piston backstroke R and the course over time of the subsequent forward motion V of the piston over the time axis t are more precisely shown, this time for only one pressing cycle of a known kind. After the end of the backstroke R at time t1, the pressure increase P in the pressing material 7 begins at time t2. After a delay, then at time t3, the discharge Q of the liquid phase begins. As is obvious, in this example, the further increase of the pressing pressure P is stopped upon reaching a pressure threshold P4 and limited to the constant value P4 (solid curve P). At a preset time t4, the pressing pressure P is turned off (see above under "Pressing operation") and another pressing cycle is initiated (not shown) with a piston backstroke.

Without pressure limiting to a value of P4, the pressing pressure P would increase according to the dashed line up to a system-dictated value Pmax. Depending upon the state of the pressing material 7, the pressed-out liquid quantity Q would be increased according to the dashed curve Q4.2 or even reduced (curve Q4.1) in comparison to the method with constant pressing pressure P4. From this, it follows that a fixed presetting of an empirical limit value P4 can hardly yield a maximal or optimal liquid quantity Q in all cases. There is also the fact that for each pressing stroke or pressing cycle, a different limiting pressing pressure P4 leads to an optimal result.

In this case, an essential improvement is now achieved in the choice of the limiting pressure suitable for a pressing stroke if according to the invention, from the course over time of the discharge behavior Q of the liquid phase, a time is determined at which the further pressure increase is limited to a constant value. An exemplary embodiment of a method of this kind is explained from FIG. 4. The onset of discharge of the liquid phase, depicted by the curve Q, at time t3 is used here as the control variable. At this time t3, the pressing pressure is limited to the value P3 which is achieved here and is kept constant, as shown by the solid curve P. For technical measurement reasons, at least a small discharge ΔQ has to be measured, to discern the discharge onset t3.

As already mentioned with regard to FIG. 3, after the beginning of the pressure increase P at time t2, the discharge Q starts, delayed to time t3. After an increasing number of pressing strokes in pressing cycles of the operation of pressing a batch, the duration between t2 . . . t3 becomes longer. That means that with a delayed discharge onset at time t3.1 in a higher- numbered pressing cycle, in the method example according to FIG. 4, the pressing pressure, which follows dashed curve P, would already have increased to a higher threshold P3.1. With a pressing material 7 which can be pressed well, the pressure threshold P3.1 and therefore the constant working pressure increases very quickly with rapidly increasing durations t2 . . . t3 from pressing stroke to pressing stroke; however, it increases very slowly with pressing material 7 which cannot be pressed well.

Figure 4:
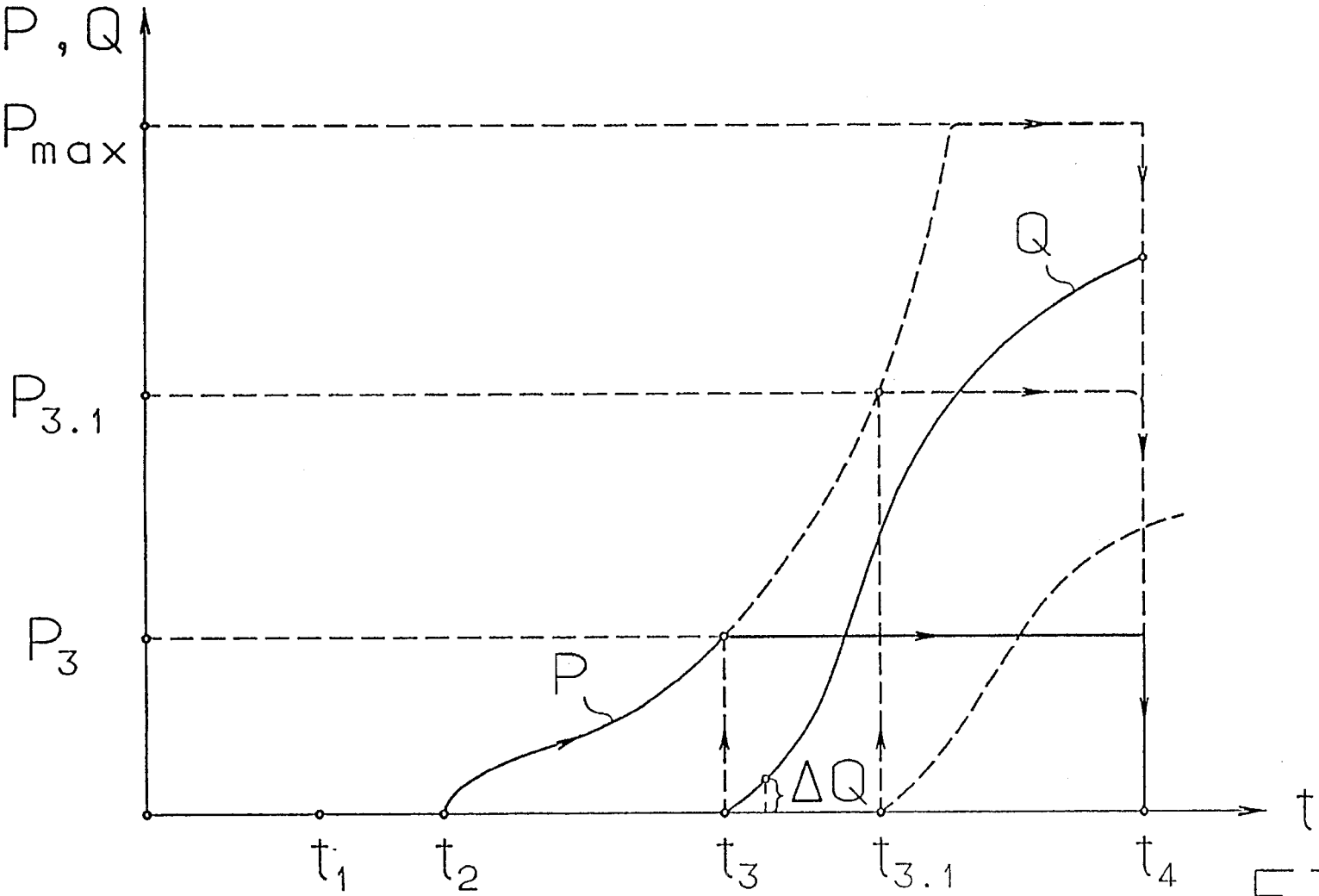
FIG. 4 is a graph showing the course over time of the pressing pressure and of the pressed-out quantity of liquid in a method example according to the invention.

In a pressing operation according to the method example of FIG. 4, generally a gradual increase of the pressing pressure of the cycles is produced. This method is used if the solids content or wet pulp content in the separated liquid phase should be as low as possible, because as a result of the low speed of compression of the pressing material, less wet pulp is separated.

Figure 5:
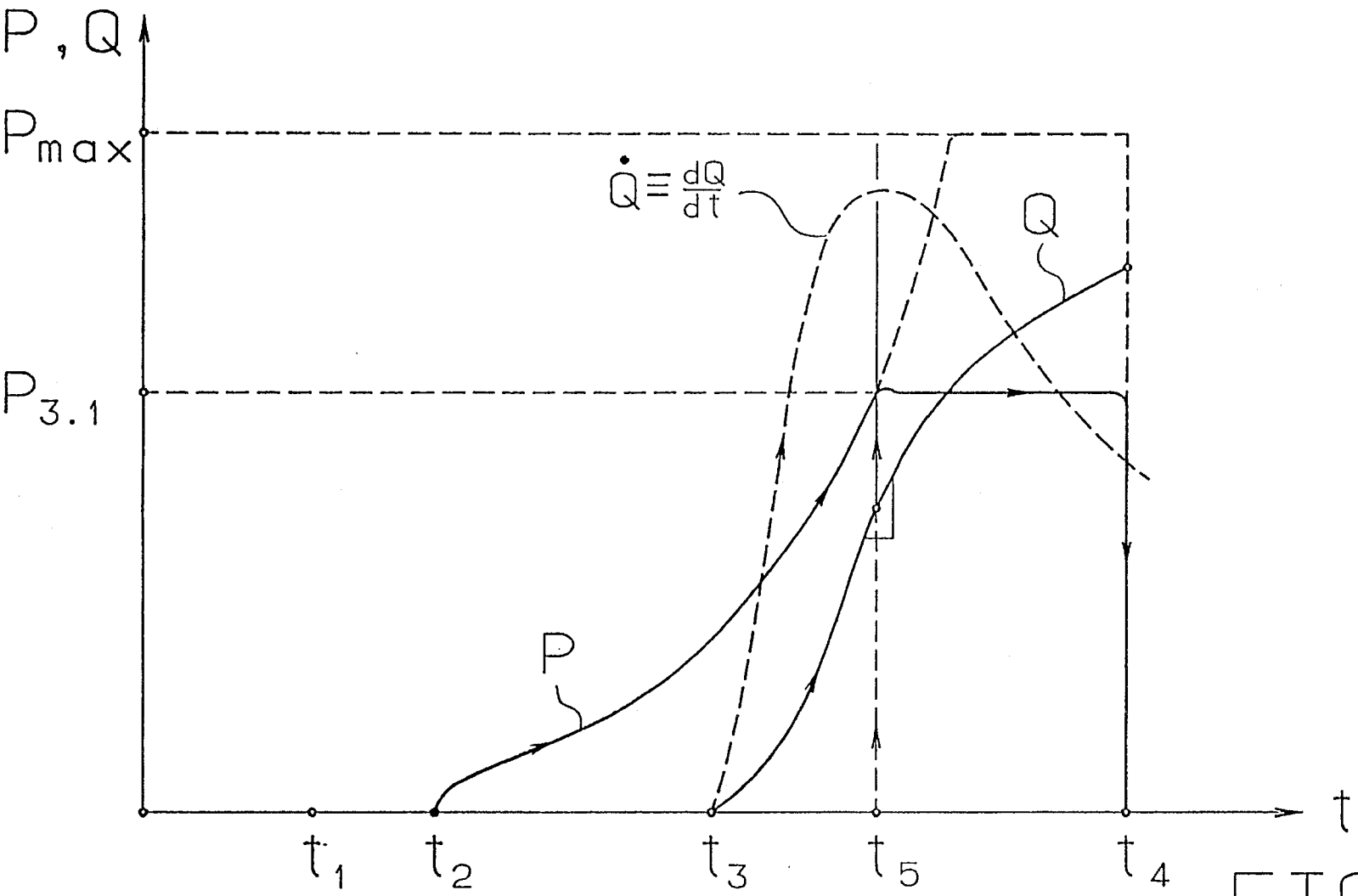
FIG. 5 is a graph showing the course over time of the pressing pressure and of the pressed-out quantity of liquid in a further method example according to the invention.

FIG. 5 also shows the course over time of pressing pressure P and pressed-out liquid quantity Q for an individual pressing cycle with a pressing stroke. Here, the times marked t1, t2, t3, t4 have the same meaning as in FIGS. 3 and 4. However in this method variant, the time t5 at which the pressure increase of curve P is stopped and limited to P3.1 is determined by the achievement of a maximal value of the momentary discharge capacity $dQ/dt \equiv Q$ point of the liquid quantity Q. This method aims at attaining an optimal combination of yield and capacity with a low wet pulp content. In comparison to the method according to FIG. 4, a quicker increase in pressing pressure P3.1 is produced in this case.

Figure 6:
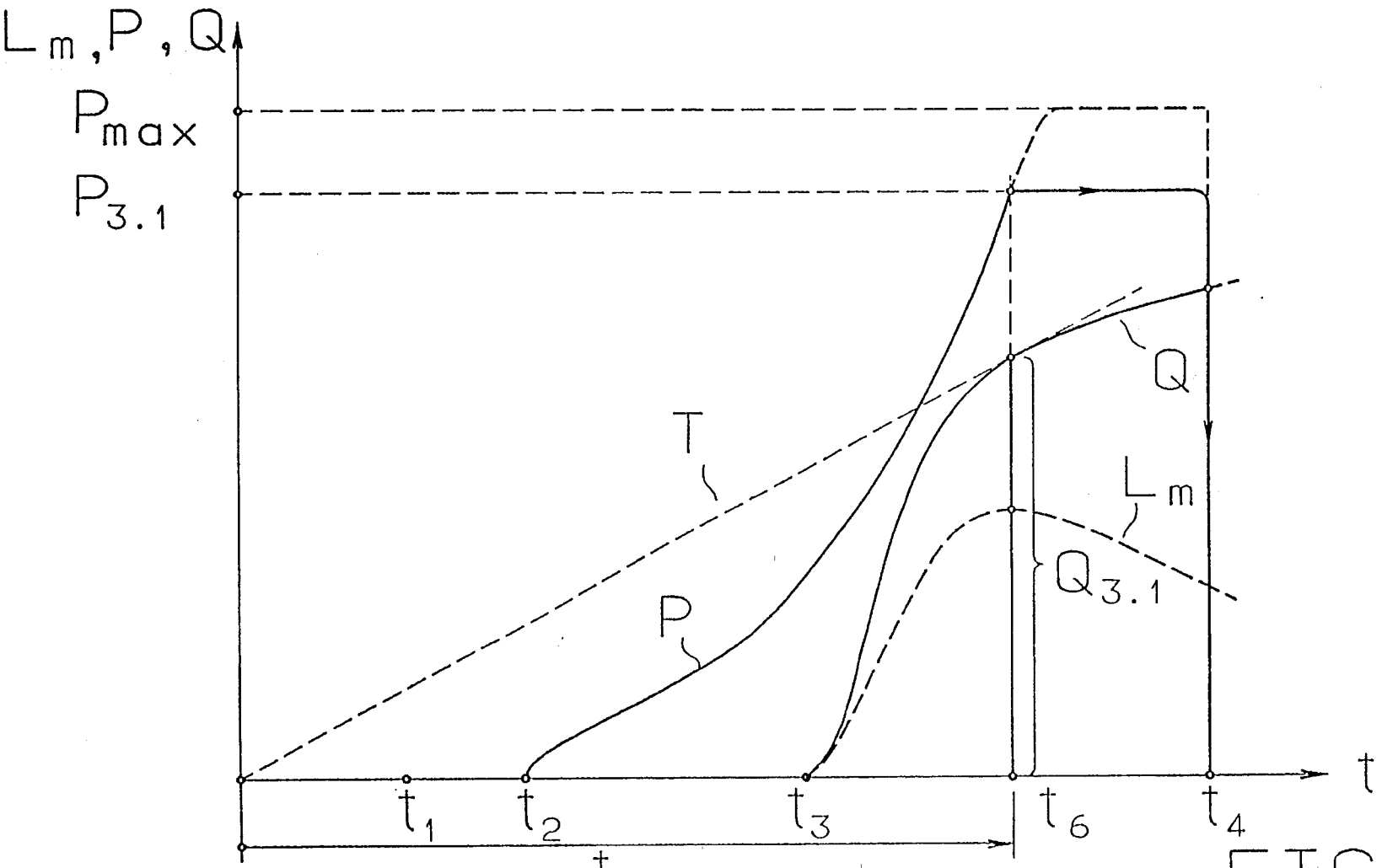
FIG. 6 is a graph showing the course over time of the pressing pressure and of the pressed-out quantity of liquid in a further method example according to the invention.

FIG. 6 illustrates the operations in a method according to the invention, in which the further pressure increase is stopped at a time t6 and limited to a value P3.1, as soon as the average discharge capacity $Q/t \equiv Lm$ of the liquid quantity Q reaches a maximal value. The course of Lm is shown in FIG. 6 by a dashed curve. The time t6 of the maximal value of Lm has to be measured from the beginning of the backstroke, that is, from the zero point on. The value of Q at time t6 is indicated as Q3.1; the maximal value of Lm at time t6 is thus Q3.1/t6. That is why t6 can be shown in graph form in FIG. 6 as the time value of the point when tangent T from the zero point meets the curve Q.

Since according to FIG. 6, the time t6 for the limiting of the pressing pressure P is greater than the limiting times t5 according to FIG. 5 and t3 according to FIG. 4, according to FIG. 6, a very rapid increase of the working pressures P3.1 is produced according to the objective of as high as possible a pressing capacity. The method according to FIG. 6 is less suited for the achievement of maximal yield since in this case the structure of the pressing material is more intensely mashed than in the method according to FIGS. 4 and 5.

Figure 7:
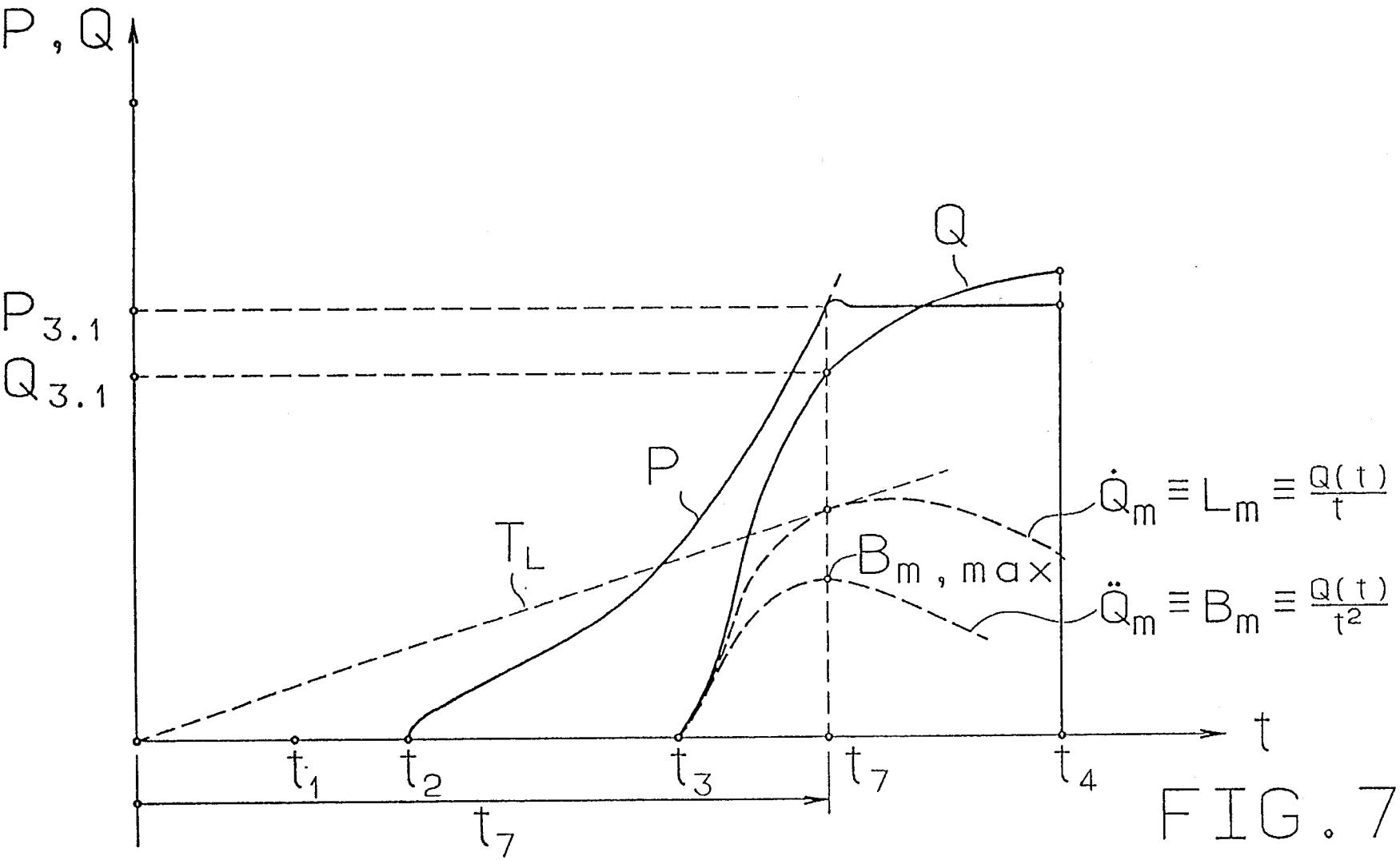
FIG. 7 is a graph showing the course over time of the pressing pressure and of the pressed-out quantity of liquid in a further method example according to the invention.

FIG. 7 shows the operations in an exemplary embodiment of the pressing method, in which the further pressure increase is stopped at a time t7 and limited to a value P3.1 as soon as the average discharge acceleration $Q/(t^2) \equiv Bm$ of the liquid quantity Q reaches a maximal value. With the indications shown in FIG. 7, the maximal value of Bm becomes $Q3.1/(t7)^2$. That is why t7 can be shown in graph form in FIG. 7 as the time value for when the tangent $T_L$ from the zero point meets the curve Lm of the average discharge capacity Q/t. In the case of separating the juice from fruits, the method according to FIG. 7 produces an optimal pressing result in terms of yield and capacity, since the average juice acceleration is the prime determinant of a rapid, gentle discharge of juice from the capillaries in the fruit material.

Figure 8:
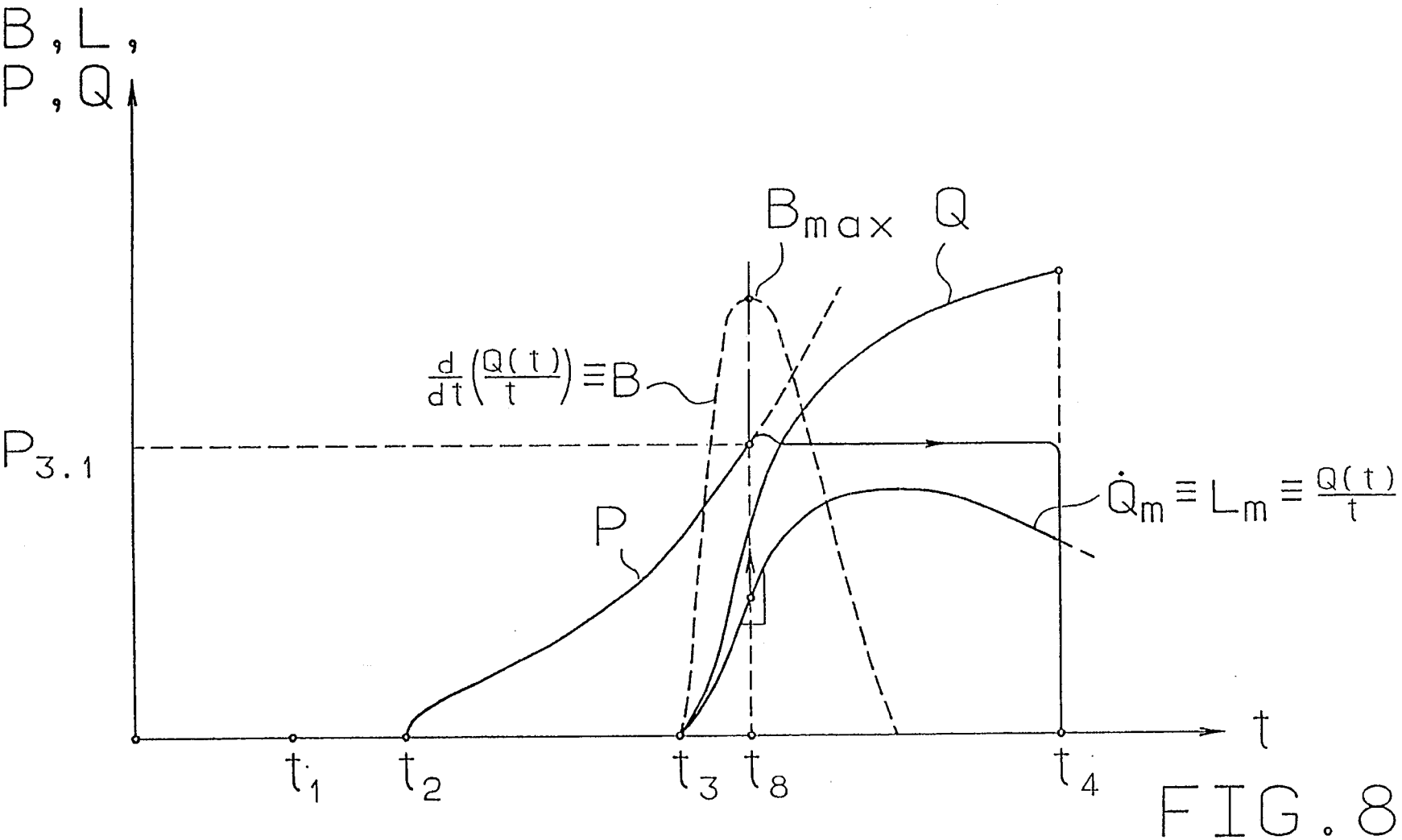
FIG. 8 is a graph showing the course over time of the pressing pressure and of the pressed-out quantity of liquid in a further method example according to the invention.

FIG. 8 shows the operations for an exemplary embodiment of the method according to the invention, in which the further pressure increase is stopped at a time t8 and limited to a value P3.1 as soon as the momentary discharge acceleration $d/dt(Q/(t)) \equiv B$ of the liquid quantity Q reaches a maximal value. This method makes particular demands in terms of measurement technique, since the curves of the liquid quantity Q(t) often have an erratic course in practice and have to be smoothed to form a differential. Also the formation of the variables dQ/dt, Q/t, or $Q/(t^2)$, which is required for the other versions of the method, is therefore carried out in a practical way for corresponding signal functions, using means for analog or digital signal processing.

Figure 9:
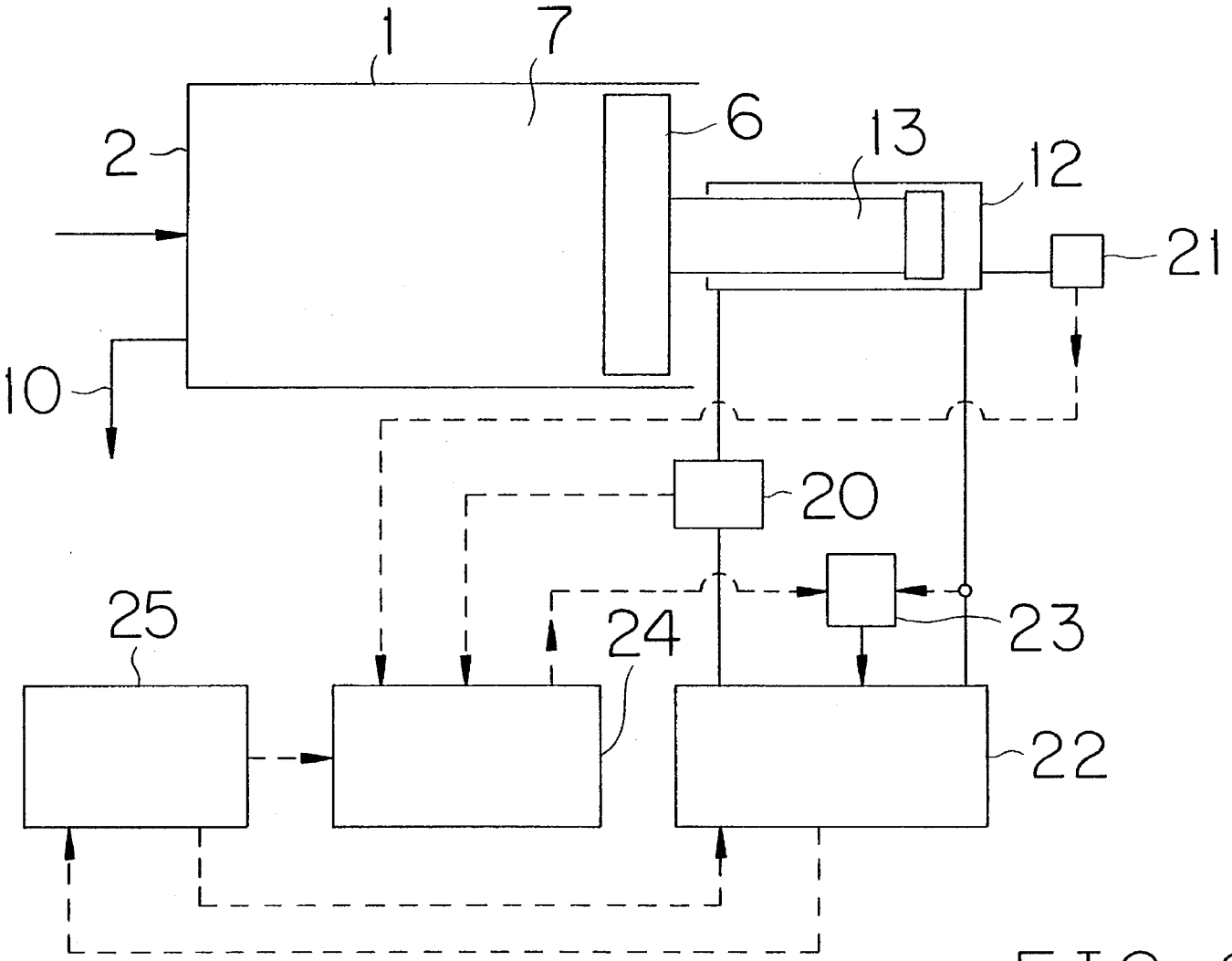
FIG. 9 shows a diagram of a system for carrying out a method according to the invention for controlling or regulating pressing pressure.

FIG. 9 shows a diagram of a system for carrying out one of the methods according to the invention for controlling or regulating pressing pressure. The press already explained with regard to FIG. 1 is shown in simplified form, with the reference numerals that have already been explained in conjunction with FIG. 1. The quantity Q of liquid discharging via the line 10 is measured by means of an oil meter 20 via the hydraulic oil withdrawn from the return chamber of the hydraulic cylinder 12. The pressing pressure P, which is exerted on the pressing material 7 by the pressing piston 6, is measured by means of a pressure transducer 21 for the hydraulic oil in the hydraulic cylinder 12. The pressing operations are controlled by a hydraulic system 22 of a known type by means of valves, pumps, and sump contained therein, together with a pressure regulating valve 23.

The output signals of oil meter 20 and pressure transducer 21 are supplied via lines, which are shown by dashed lines, to a process regulator 24 along with a pressure regulator. In the process regulator 24, the required signal processing and time determinations are carried out, which are described with regard to FIGS. 4–8. Here, the control commands for the controlling or regulating of the pressing pressure according to the invention are also produced for the hydraulic cylinder 12 and transmitted to the hydraulic system 22. An electrical control 25, which triggers the hydraulic system 22, is provided for the operation of the press, the start of the pressing operations, as well as further automatic courses of the method.

The method according to the invention makes possible optimal pressure limits, depending on the intended objective, in a press from one pressing stroke to another, these limits being adapted to the separating behavior of the pressing material. No desired value predeterminations are required aside from the controlling or regulating procedure chosen. Troublesome predeterminations of desired or empirical values can be avoided, and product data are not required. The press operates in a process of self-optimization to the pressing pressures and to the times to which the pressure increase is to be limited.

I claim:

1. A method for controlling or regulating the pressing pressure for the separation of solids and liquids from pressing material (7) by means of a press (1, 2, 6), which performs at least one pressing cycle during a pressing operation by means of a pressure increase, characterized in that the discharge (Q) of the liquid phase from the press (1) is directly or indirectly measured, and that from the course over time of the discharge behavior (Q) of this phase, an instant (t3, t5, t6, t7, t8) is determined at which the further pressure increase (P) is limited to a constant value (P3, P3.1, P4), wherein for each pressing cycle, this instant lies within a time interval which starts at the beginning of discharge (Q) and which ends after a certain length of time, which is equal to twice the length of time between the beginning of discharge (t3) and the onset (t6) of maximal average flow capacity ((Q/t)max) of the liquid phase.

2. The method according to claim 1, characterized in that the pressing cycles of the press have periods with and without discharge of liquid phase, and that as the instant at which the further pressure increase is limited to a constant value (P3.1), a moment (t6) is chosen at which the average discharge capacity (Q/t), which is measured during the time (t) since the end of the previous discharge, reaches a maximal value, wherein Q indicates the quantity discharged in the time t.

3. The method according to claim 1, characterized in that as an instant at which the further pressure increase is limited to a constant value (P3.1), a moment (t5) is chosen at which the momentarily measured discharge capacity (dQ/dt) reaches a maximal value, wherein Q indicates the quantity discharged in the time t.

4. The method according to claim 3, characterized in that the moments (t5) at which the momentary discharge capacities reach their maximal values are found by means of forming the differentials dQ/dt of signal functions that correspond to the discharged quantity Q.

5. The method according to claim 1, characterized in that the pressing cycles of the press have periods with and without discharge of liquid phase, and that as the instant at which the further pressure increase is limited to a constant value (P3.1), a moment (t7) is chosen at which the average discharge acceleration $(Q/(t)^2)$, which is measured during the time (t) since the end of the previous discharge, reaches a maximal value, wherein Q indicates the quantity discharged in the time t.

6. The method according to claim 1, characterized in that the pressing cycles for the press have periods with and without discharge of liquid phase, and that as the instant at which the further pressure increase is limited to a constant value (P3.1), a moment (t8) is chosen at which the instantaneous discharge acceleration (d/dr(Q/t)), which is measured during the time (t) since the end of the previous discharge, reaches a maximal value, wherein Q indicates the quantity discharged in the time t.

7. The method according to claim 6, characterized in that the moments (t/8) at which the instantaneous discharge accelerations reach their maximal values are found by means of forming the differentials d/dt (Q/t) of signal functions that correspond to the average discharge capacity Q/t.

8. The method according to claims 1, characterized in that the pressing cycles of the press have periods with and without discharge of liquid phase and that the further pressure increase is limited, for at least one pressing cycle, to a value which is not determined by means of a time determined from the discharge behavior within this pressing cycle, and that not until subsequent pressing cycles is the further pressure increase limited to values which are determined by means of instants that are determined from the discharge behavior within these subsequent pressing cycles.

* * * * *